United States Patent [19]

Hoover

[11] 4,269,569

[45] May 26, 1981

[54] AUTOMATIC PUMP SEQUENCING AND FLOW RATE MODULATING CONTROL SYSTEM

[76] Inventor: Francis W. Hoover, 6105 Desert Hills, Bakersfield, Calif. 93309

[21] Appl. No.: 49,180

[22] Filed: Jun. 18, 1979

[51] Int. Cl.[3] ..... F04B 41/06

[52] U.S. Cl. ..... 417/5; 417/347

[58] Field of Search ..... 417/1-5, 417/43, 46, 339, 347

[56] References Cited

U.S. PATENT DOCUMENTS

| | | | |
|---|---|---|---|
| 1,557,222 | 10/1925 | Warner | 417/2 |
| 3,249,053 | 5/1966 | Govan | 417/5 |
| 3,432,088 | 3/1969 | Steiger | 417/5 |
| 3,610,848 | 10/1971 | Rosenberg | 417/1 X |
| 3,627,449 | 12/1971 | Salo | 417/339 X |
| 3,639,081 | 2/1972 | Gray et al. | 417/43 X |

FOREIGN PATENT DOCUMENTS

| | | | |
|---|---|---|---|
| 969026 | 6/1975 | Canada | 417/339 |
| 324156 | 1/1930 | United Kingdom | 417/5 |

*Primary Examiner*—Philip R. Coe
*Attorney, Agent, or Firm*—Dennis B. Haase

[57] ABSTRACT

The present invention relates to a control system for automatic, continuous sequencing and modulating the flow rate of a plurality of high pressure pumps, having specific, albeit not exclusive application to mud pumps used in well drilling procedures.

More particularly, the essence of the invention reposes in a novel volume output sensing servo system which continuously senses deviation in pump drive fluid volume output and automatically responds to such changes to maintain proper pump sequence.

9 Claims, 5 Drawing Figures

AUTOMATIC PUMP SEQUENCING AND FLOW RATE MODULATING CONTROL SYSTEM

BACKGROUND OF THE INVENTION

The use of drilling mud is an essential adjunct to the rotary drilling procedures, which procedures date back to the turn of the century. A highly viscous fluid material called "mud" (primarily because in the early days it consisted of soil and water) is forced down the drill stringer under high pressure and jetted out through the drill bit to cool as well as clean the bit. The mud material returns upwardly through the annulus about the drilling string, thereby carrying away loose material and in some instances adding additional support against potential collapse of the hole strata.

Because of the high viscosity of the mud and the high pressure and flow requirements, particularly for deep well drilling, piston or plunger type pumps have been found the most serviceable and satisfactory. Very early pumps were steam driven reciprocating pistons in a liner. Over the years the simplex pump was developed and was followed by a duplex, and more recently, a triplex pump which was placed into service in about 1953. The duplex and triplex pumps are in wide use today and typically comprise an aggregation of bull gears, bearings, seals and other high maintenance inner workings. Pumps of this type typically move at high speeds and have a very short piston stroke, the inevitable consequence of which is high liner and valve maintenance.

The pump to which the present invention is adapted is in reality a series of pump assemblies, plumbed in parallel each of which is relatively simple, involving a minimum of moving parts. The pump, by virtue of its construction, is capable of lower operating speeds than those now in use, with a commensurate lower maintenance cost. Each of the pumps comprises a piston operating within an elongated liner with a rod interconnecting the piston to a fluid drive motor which is reciprocated to move the piston through a suction stroke to draw viscous mud into the liner and a return or discharge stroke to force the mud under pressure to the drill string.

In order to effectively use pumps of the type described, all of the pump assemblies which comprise the whole must be properly sequenced and sychronized in order to avoid pressure surges in the discharge line which, if permitted, could result in severe damage to the entire mud circulation system, including the well hole.

It is characteristic that the type of pump to which the present invention pertains to lose synchronization when pump operating speed is adjusted, and the present invention is particularly useful in overcoming this undesireable characteristic through its ability to continuously monitor variations in fluid flow which equates to pump speed changes and to automatically adjust to such changes to maintain proper sequencing.

Triplex and duplex mud pumps currently in use recognize the problem and even though they are mechanically synchronized, expensive pulsation dampeners are customarily used on the discharge side to avoid surge and pressure peaks. Additional force feed equipment is needed to assist the pumps in the process of ingesting mud during the suction stroke. A significant feature of the present invention is that a control system is provided which insures proper sequencing through the full range of operating speeds, thereby permitting the delivery to the drill string of a highly uniform mud flow rate and pressure without recourse to ancillary equipment such as pulsation dampeners and forced suction flooding. Thus, it is that a major contribution to rotary drilling is made by the present invention which permits the use of a plurality of fluid driven pumps, connected in parallel by providing means for automatically and continuously sequencing each pump with the others to permit delivery to the drill string of mud at a pre-determined and modulated flow rate and pressure.

DESCRIPTION OF THE DRAWINGS

Having thus summarized the invention, there is appended hereto two sheets of drawings wherein the preferred embodiment of the invention is illustrated in conjunction with the environment for which it is ideally suited. The drawings comprise.

DESCRIPTION OF THE PREFERRED EMBODIMENT

Figure 1:
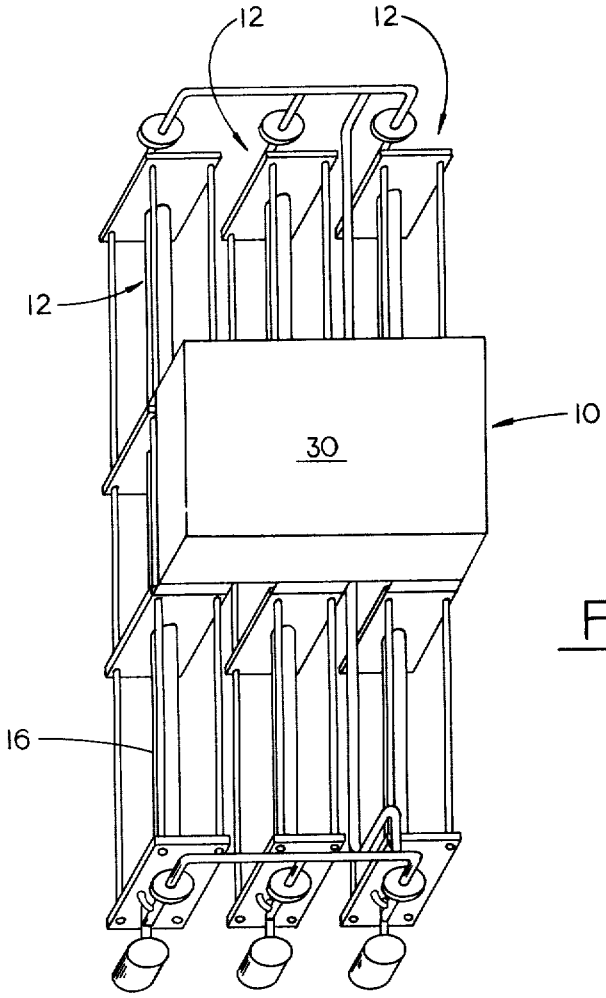
FIG. 1, which is a pictorial layout of a sixplex mud pump of the type to which the present invention is particularly, although not exclusively, adaptable.
Figure 2:
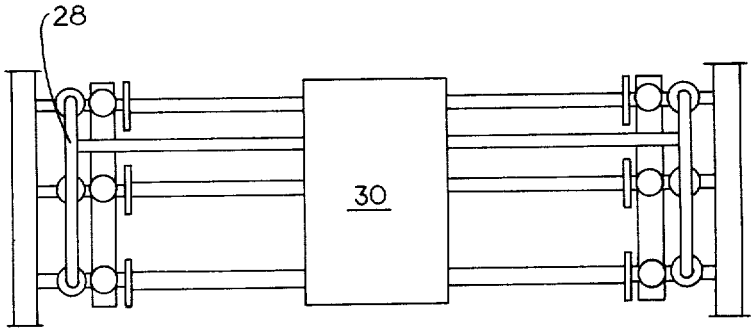
FIG. 2, which is a top plan view of the device of FIG. 1.
Figure 3:
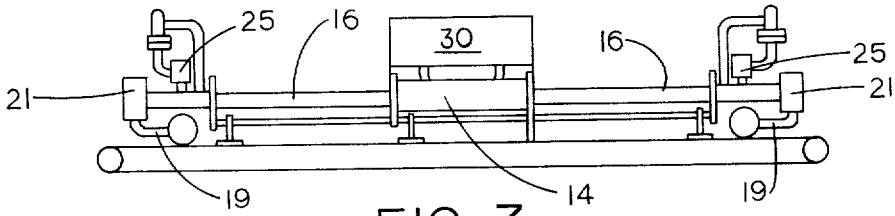
FIG. 3, which is a side elevation of the apparatus shown in FIG. 1.
Figure 4:
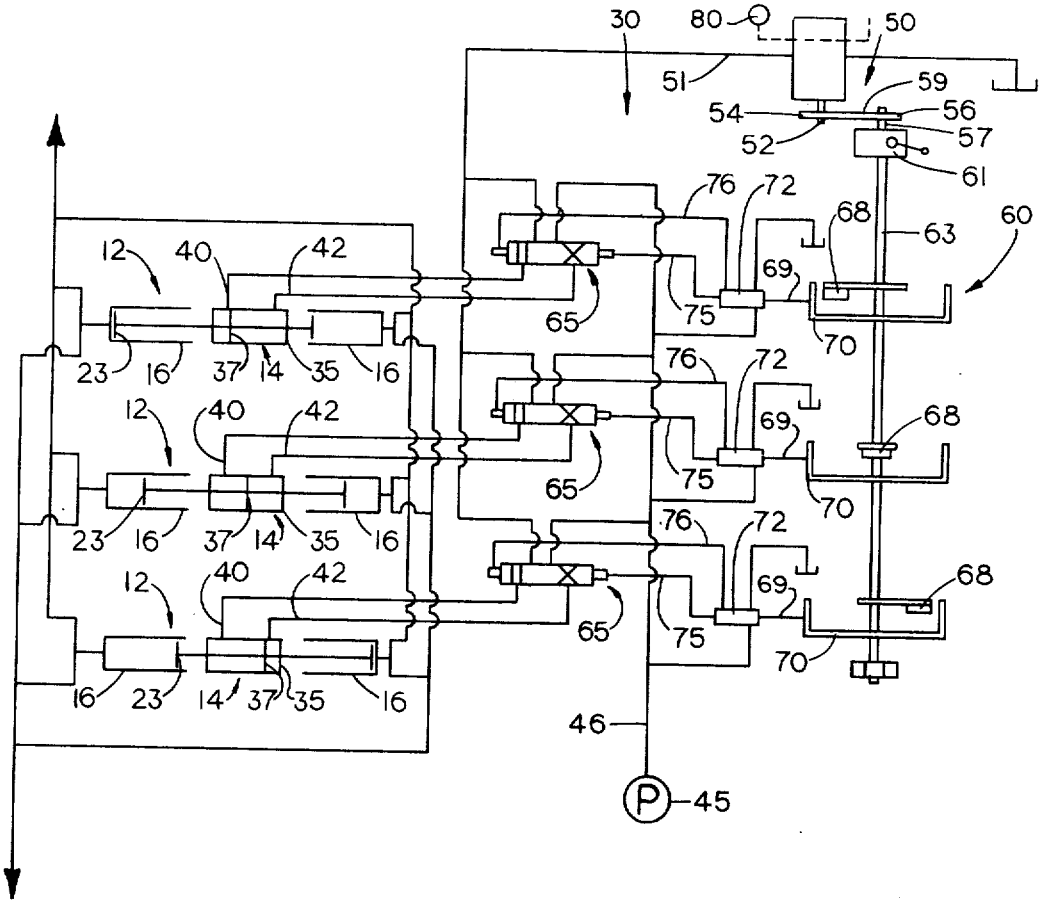
FIG. 4, which is a schematic diagram of the control system of the present invention.

With reference now to the drawings, and particularly FIG. 1, there is illustrated a fluid driven mud pump 10 representing the environment within which the invention has particular application. As illustrated, the pump 10 comprises three pumping assemblies 12, although it would be feasible to use a different number of assemblies. The individual assemblies are disposed in and connected to function in parallel to form the pumping unit. Each assembly comprises, as best seen in FIG. 3, a centrally disposed fluid drive motor 14 with a pair of axially aligned combination rod housing and liner assemblies 16 extending therefrom. Each assembly is identical in design, and since the structure of the assemblies as well as their operation is of general concern only, and represents the environment within which the preferred embodiment functions, no effort has been made to provide a detailed drawing or description. The schematic of FIG. 4 is believed to be adequate for purposes of understanding the invention.

Again referring to FIG. 3, a suction or intake line 19 is illustrated at either end of each rod housing liner assembly. The lines 19 connect to the mud reservoir and one way valves 21 of known construction permit mud to be sucked into the liner assembly as each piston 23 (illustrated only schematically in FIG. 4) is retracted toward the drive motor. As the piston moves forward on its power or discharge stroke, of course, mud under pressure is forced through one way valve 25, also of known construction, into the high pressure line 28 from which it is fed to the stringer on the rig, not shown.

As previously indicated, the physics of the arrangement described, absent some sequence and synchronization, will result in the eventual pumping alignment of the drive motors of each of the pumping assemblies 12. The inevitable consequence of this tendency towards gnment is that the pumps on one end will deliver mud to the discharge line in unison, and 180° of movement later each of the pumps on the other end will likewise deliver. The result is a pressure surge or more accurately, a series of pressure surges in the high pressure line 28. Such surges simply can not be tolerated and there is provided, therefore, in keeping with the invention, an automatic pump sequencing and flow rate modulating control system which is housed at 30 and which is illustrated in detail in FIG. 4.

When three assemblies 12 are used, optimum flow and pressure characteristics are achieved by synchronizing each of the assembly drive motors precisely 120° out of phase with the other assemblies. Sinch each drive motor operates two coaxially aligned pressure pumps, a full cycle of the mud pump 10 will result in the sequential discharge of six relatively equally spaced (in time) quantities of mud into the discharge line. Since the pump described permits a very long stroke as distinguished from the much shorter strokes used by currently popular mud pumps (in some instances the difference is as much as 8 to 1) the tendency towards high amplitude, high frequency pulsing in the discharge line is minimal. When proper synchronization is achieved, as by the control system 30, the tendency towards surging or pulsing is likewise reduced substantially since therey are, in the pump described, six equally spaced injections of equal volume of mud into the discharge line, which are phased in such a manner as to bring about a smoothing of the flow rate surges.

Figure 5:
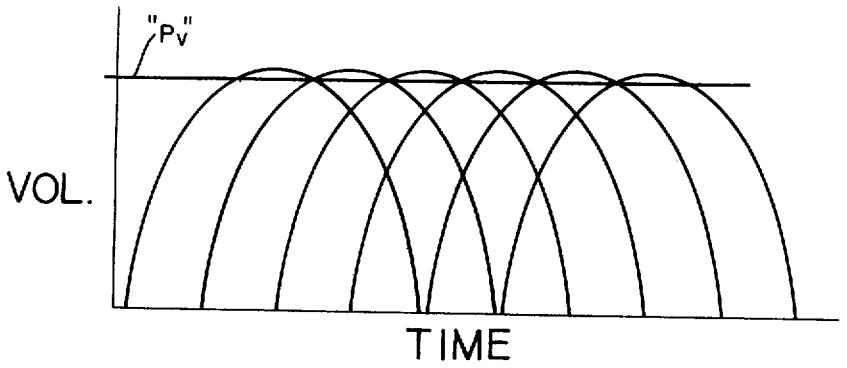
FIG. 5 is a graphic display of the flow pattern of the fluid pumped to the drill string when the control system of the present invention is functioning in conjunction with the pump of FIG. 1.

FIG. 5 is provided to give a graphical presentation of the blending of the individual injection responses in the discharge line. Six curves representing the discharge of each of the pumps are shown in timed sequence. The horizontal line $P_v$, represents the quanitative value of the pump effort for each cycle, and demonstrates the smoothness of flow resulting from the present invention. It is well known that on a conventionally powered pump as the piston travels through its cycle, the fluid velocity, if plotted against time or travel of the piston, displays an essentially sinusoidal characteristic. By the use of the constant speed hydraulic powered cylinder motor, as seen in FIG. 5, proper phasing of the pumps brings about a smoothing of the sinusoidal curve and an evening of pressure and flow. It is equally apparent that should the drive motors be permitted to become out of phase, as previously discussed, the peaks and valleys of the various curves would re-enforce one another rather than modulate, resulting in additive and thus destructive high amplitude surges in the discharge line.

The fluid drive motors are operated from a controllable pressure source 45 which may be readily available on a hydraulic rig. By tapping into the source of fluid power and providing any suitable control means for regulating fluid flow to the drive motors, the speed of the motors can be controlled to meet varying demands for mud in the well hole. As fluid flow is adjusted to change speeds, the control system 30 senses those changes and automatically maintains the motors in sync in the manner herein disclosed. As may be seen in FIG. 4, the drive motor is nothing more than a cylinder 35 having a piston 37 reciprocable therein. It is obvious that the piston 37, when centered in the cylinder 35, divides the cylinder into two chambers of equal volume and that as the piston 37 moves within the cylinder, the volume of fluid entering one of the chambers is equal to the volume leaving the other. When fluid at a determined flow rate is introduced into either lines 40 or 42 from a fluid power source 45 to each drive motor, the drive motor piston is driven in the direction of fluid application, resulting in one of the coaxially opposed assemblies 16 attached to it executing a suction stroke while its opposite will be on a discharge stroke. If, for example, fluid under pressure is introduced through line 40, the piston will move to the right as seen in FIG. 4 and the fluid previously filling the volume in the cylinder between the piston and the end wall of the drive motor cylinder will be discharged through line 42. Because the chambers in the drive motor are of equal volume, the rate and quantity of fluid introduced into line 40 through a common source line 46 necessary to bring about full travel of the piston 37 will result in the discharge of an equivalent amount of fluid in line 42 and at the same rate. As a consequence, it has been determined that flow rate variations may be sensed either on the pressure side or the discharge side of the drive motor power source.

Accordingly, and in keeping with one aspect of the invention, the control system 30 includes a servo mechanism 50 which, in the illustrated case, has been interconnected into a cumulator discharge line 51 which receives all of the discharge from lines 42 leading from the drive motors and deliver it ultimately to a sump at the fluid power source. The servo mechanism, which is of known construction, senses or measures the flow rate through the discharge line and in the illustrated case, translates it into rotary motion which is used to transmit changes in flow to a switch control assembly 60 operable to maintain fluid motor synchronization. Several devices such as that shown at 50 for transmitting information are known in the art. In the illustrated case, however, flow rate measurement is converted to rotary motion at shaft 52. Shaft 52 carries a pulley 54 which is connected to a pulley 56 disposed on an input shaft 57 to the switch control mechanism 60 by a belt 59. The switch control mechanism includes means for fine adjustment, and thus, the shaft 57 is disposed on the input side of a fine adjustment mechanism 61, the output of which is connected to drive shaft 63. The mechanism 61 may be any one of a number of known speed adjustment mechanisms such as, for example, the readily available zero-max.

In order to insure constant proper synchronization and phasing of the drive motors, the invention permits precise control of both the direction and duration of movement or stroke of the piston 37 within the drive motor. This is accomplished by the alternate timed interconnecting of lines 40 and 42 to the high pressure side 46 of the driving fluid source to reciprocate the drive motor. For this purpose, switches comprising spool valves 65 for each pump assembly are interposed between the high pressure driving fluid source 45 and the cumulator discharge line 51. The precise operation of spool valves of the type illustrated is well known and need not be detailed other than to say that by moving the spool laterally in one direction or the other within its housing, lines 40 and 42 are selectively connected to the source 45 or the discharge line.

In order to maintain proper phasing of the pumps, the switching assembly responds to flow in the cumulator line through the servo mechanis 50 to time the movement of each of the valves 65. This is accomplished in accordance with the present invention through the use of a camming mechanism which is part of the switching assembly, and which is attached to the shaft 63. The camming mechanism includes a rotating cam 68 which operates between space lobes of a reciprocal follower 70. The lobes of the follower are axially aligned on opposite sides of the cam so that they will be engaged by the cam twice during its 360° rotation, thus resulting in reciprocation of the follower. A plunger 69 connects to the follower and is reciprocal with it to reciprocate a switch 72 of known construction. The switch 72 in the illustrated case is a simple spool valve. The switch 72, of course, is connected, in the illustrated case, by means of hydraulic lines 75 and 76 to either end of its companion spool valve 65 so that acutation of the switch will result in movement of the spool valve to the desired sequencing position.

Again referring to FIG. 4, it will be quickly ascertained that in order to provide proper sequencing with the use of these drive motors each of the cams 68 are preset to be precisely 120° out of phase with one another. Each cam will engage its follower twice in 360° of rotation, thereby actuating and reversing each of the switches 72 every 180° as a result one of the drive motors is reversed with every 60° rotation of the shaft 63. As a consequence, each of the motors is precisely phased at all times and without regard to changes in flow rate as sensed by the servo motor 50, so as to cause the assemblies 12, acting as a unit, to deliver mud at the precise modulated flow rate desired. Needless to say, any number of drive motors may be sequenced by setting the cams at equal intervals which may be determined by dividing 360° by the number of drive motors and setting the cams accordingly.

The preferred embodiment has been illustrated and described with respect to the use of a fluid power source customarily available at a hydraulic rig. While such sources are convenient, most conventional rigs are not hydraulic. The control system of the present invention is no less effective under circumstances where the source of fluid power to the drive motors must be generated separate and apart from the rig. It will be appreciated that in light of the fact that the relationship between fluid flow from the power source and the action of the fluid drive motors is a proportionate relationship, the control system of the present invention may, without departure therefrom, be operated by means of an independent source which bears a proportionate relationship to the fluid volume delivered to and discharged from the fluid motors. Thus, instead of using the substantial flow rates experienced in lines 46 and 51, the servo motor 50 may be connected to a fluid power source 80 which is constructed to provide a constant and continuous proportional relationship between the lines 46 and 51 and that delivered to the servo motor 50, and measures that proportionate fluid flow to effect control. So long as the proportional relationship is observed, the operation of the control system of the present invention will be the same. Such an arrangement has an additional advantage in that the alternate source 80 may be as much as 10 or even 20 times lower in flow rate as the main power source, so long as a constant proportional relationship is maintained. Accordingly, much smaller equipment can be used to provide increased safety and a cost saving.

The control system of the present invention is designed primarily to cause the drive motors to reciprocate in perfect synchronization and at full stroke irrespective of speed. However, in actual operation, it may be necessary or desirable to provide for a shorter stroke, such as, for example, if the only liners available are shorter than those originally in use. In order to avoid a shut down until replacements of the original length are available, the stroke may be adjusted by means of the fine speed ajustment mechanism 61 to permit use of available shorter liners, or for any other reason which the situation requires.

It will likewise be evident that it it is within the contemplation of the invention that it is the function, rather than the construction of the various elements of the control system which is novel and that valving, camming and switching arrangements well known in the art may be substituted for the specific elements illustrated without departure from the invention so long as the interrelationship and function of the various elements is observed.

Having now described my invention, I claim:

1. A control system for automatically and continuously sequencing and modulating the output of pumping apparatus, for moving fluid under pressure at a predetermined flow rate, which apparatus includes a plurality of reciprocating pumps, fluid powered drivers connected to said pumps to drive said pumps, each said pump including valving devices for controlling the introduction of fluid to be moved to, and the ejection of fluid from said pumps, said power drivers each connected to an adjustable power source for delivering fluid to said power drivers for driving said power drivers at a predetermined rate, said control system comprising sensing means for sensing the flow rate of fluid discharged from said power drivers, movable switching means interposed between said power source and said power drivers for selectively directing fluid to each of said power drivers, means interconnecting said sensing means and each said switching means for sequentially operating said switching means in timed relation in response to fluid flow from said power source, thereby continuously and automatically sequencing each said pump in response to changes in said power source.

2. The apparatus as set forth in claim 1 including means defining a servo mechanism interconnected with said sensing means for transforming information received by said sensing means into rotary motion, rotatable cam means engageable with each said switching means to selectively operate the same, said cam means being interconnected with and rotatable by said servo mechanism to move said cam means in proportionate relation to drive fluid delivered by the fluid power source to said powered drivers.

3. The apparatus of claim 2 wherein said cam means includes a shaft, a series of rotatable cams, on said shaft, each one of which engages a cam follower interconnected with one of said switches, said cams being sequenced to engage it associated said cam follower at least once for every 360° rotation of said shaft, and each said cam being sequenced with respect to each other said cam in accordance with the relationship of 360° divided by the number of cams on said shaft.

4. The apparatus of claim 2 wherein said cam means operates said switching means to provide a stroke of predetermined length for each pump assemblies.

5. The apparatus of claim 4 wherein said servo mechanism includes speed adjustment means for varying the rotary motion transmitted to said cam means to thereby vary the stroke of said pumping apparatus.

6. A control system for automatically and continuously sequencing and modulating the output of pumping apparatus for moving fluid under pressure at a predetermined flow rate, which apparatus includes a plurality of reciprocating pumps, fluid powered drivers connected to said pumps to drive said pumps, each said pump including valving devices for controlling the introduction of fluid to be moved to, and the ejection of fluid from said pumps, said power drivers each connected to an adjustable power source for delivering fluid to said power drivers, a second power source adapted to generate fluid flow in a predetermined ratio with respect to said fluid power source, said control system comprising sensing means for sensing the flow rate of fluid from said second power source to said power drivers, movable switching means interposed between said second power source and said power drvers for selectively directing fluid to each of said power drivers, means interconnecting said sensing means and each said switching means for sequentially operating said switching means in timed relation in response to fluid flow from said second power source, thereby continuously and automatically sequencing each said pump in response to changes in said second power source.

7. The apparatus of claim 6 with means defining a servo mechanism interconnected with said sensing means for transforming information received by said sensing means into rotary motion, rotatable cam means engageable with each said switching means to selectively operate the same, said cam means being interconnected with and rotatable by said servo mechanism to move said cam means in proportionate relation to drive fluid delivered by said fluid power source, to said pumping apparatus.

8. The apparatus of claim 6 wherein said cam means operates said switching means to provide a stroke of predetermined length for each pump assemblies.

9. The apparatus of claim 6 wherein said servo mechanism includes speed adjustment means for varying the rotary motion transmitted to said cam means to thereby vary the stroke of said pumping apparatus.

* * * * *